United States Patent [19]

Terasawa

[11] Patent Number: 4,607,425

[45] Date of Patent: Aug. 26, 1986

[54] CURVED SLIDE FASTENER CHAIN AND METHOD FOR PRODUCING CURVED SLIDE FASTENER

[75] Inventor: Akinobu Terasawa, Toyama, Japan

[73] Assignee: Yoshida Kogyo K. K., Tokyo, Japan

[21] Appl. No.: 556,094

[22] Filed: Nov. 29, 1983

[30] Foreign Application Priority Data

Dec. 3, 1982 [JP] Japan ..... 57-213020
Dec. 16, 1982 [JP] Japan ..... 57-190807[U]

[51] Int. Cl.[4] ..... B21D 53/50
[52] U.S. Cl. ..... 29/408
[58] Field of Search ..... 29/408–410, 29/766–770, 33.2

[56] References Cited

U.S. PATENT DOCUMENTS 2,511,414 6/1950 Poux ..... 29/408
2,623,214 12/1952 Yaffe ..... 29/408
2,697,227 12/1954 Prupis ..... 29/408

*Primary Examiner*—Mark Rosenbaum
*Assistant Examiner*—Steven Nichols
*Attorney, Agent, or Firm*—Hill, Van Santen, Steadman & Simpson

[57] ABSTRACT

A curved slide fastener chain and a method for producing a curved slide fastener are disclosed. The curved slide fastener chain comprises a pair of fastener tapes and a plurality of fastener element rows planted on each of a pair of the fastener tapes. Each of the element rows includes a straight and a curved inter-engagement portion. The curved inter-engagement portions are disinter-engaged while the straight inter-engagement portions are inter-engaged, so that each of the pair of fastener tapes are able to extend in a straight line. Therefore, deformation of the curved inter-engagement portions due to heat and tension applied thereto during the washing, dewatering and drying steps in producing a curved slide fastener can be prevented.

1 Claim, 15 Drawing Figures

CURVED SLIDE FASTENER CHAIN AND METHOD FOR PRODUCING CURVED SLIDE FASTENER

BACKGROUND OF THE INVENTION

This invention generally relates to a curved slide fastener, and more particularly concerns a curved slide fastener chain from which curved slide fasteners are formed and a method for producing a curved slide fastener.

Straight slide fasteners having no curved portion therein are produced by the method including the steps of:

(a) forming a pair of fastener stringers by planting a plurality of fastener element rows of a unit length on each of a pair of fastener tapes in series and spaced relation;

(b) inter-engaging a pair of fastener stringers to form a fastener chain;

(c) washing and dewatering the fastener chain;

(d) drying the fastener chain dewatered while applying tension to the fastener chain; and (e) forming slide fasteners by cutting the fastener chain into a unit length after applying parts, such as, bottom stops and sliders to the fastener chain.

In contrast with the aforementioned straight slide fastener, a curved slide fastener, to which this invention is directed, has a curved portion therein, so that difficulties arise in producing a curved slide fastener according to the aforementioned method for producing straight slide fasteners.

As shown in FIG. 1, a curved slide fastener F comprises a pair of fastener stringers 1 and 2, a bottom stop 14, two upper stops 16, and a slider 15. Each of the fastener stringers includes a fastener tape 3 (or 4) and a fastener element row 5 (or 6) formed by planting fastener elements on the inner side edge of the fastener tape 3 (or 4). Each fastener element row 5 (or 6) has a straight inter-engagement portion 9 (or 10) and a curved inter-engagement portion 11 (or 12). The element pitches P1 and P2 in the straight inter-engagement portions 9 and 10, respectively, are identical to one another, while the element pitches P3 and P4 in the curved inter-engagement portions 11 and 12, respectively, are different to one another. In the embodiment shown in FIG. 1, the element pitch P4 is larger than the element pitch P3, so that the curved inter-engagement portions 11 and 12, when interengaged together, represent a curved line in the plane in which the line represented by the straight inter-engagement portions 9 and 10 extends.

Referring to FIG. 9, a conventional curved slide fastener chain is illustrated from which a curved slide fastener described above is produced. The conventional fastener comprises a pair of fastener stringers 1' and 2' each having a plurality of fastener element rows 5' or 6' disposed in series and spaced relation on the inner side edge of their respective fastener tapes 3' or 4'. Each fastener element row 5' and 6' includes a straight inter-engagement portion 9' or 10' and a curved inter-engagement portion 11' or 12'. The element pitches P1' and P2' in the straight portions 9'and 10', respectively, are identical to one another, while the element pitches P3' and P4' in the curved portions 11' and 12', respectively, are different to one another. In this example shown in FIG. 9, the pitch P4' is larger than the pitch P3' so that, when the element rows 5' and 6' facing one another are inter-engaged together, the curved portions 11' and 12' curve downwardly in the drawing.

As is apparent from FIG. 9 illustrating a curved slide fastener chain according to prior art, it is noted that spaces 7' and 8' between the element rows 5' and 5a' and the element rows 6' and 6a', respectively, have the same length. Further, it is also noted that each pair of element rows e.g., 5' and 6' are inter-engaged together over their entire length.

When it is intended to produce curved slide fasteners from the aforementioned conventional curved slide fastener chain by the same method for producing straight slide fasteners mentioned hereinbefore, there occurs a problem or difficulty in preservation of the curved configuration initially given to the curved inter-engagement portions because the curved inter-engagement portions are extended by means of heat and tension applied to the curved slide fastener chain during the drying step.

In order to avoid the aforementioned problem arising in producing curved slide fasteners from the conventional curved slide fastener chain by the method for producing straight slide fasteners, as shown in FIGS. 10(A) to 10(F), curved slide fasteners are conventionally produced by the method including the steps of:

(a) forming a pair of fastener stringers 1'—1', each of which will form one of a pair of fastener stringers 1' and 2' constituting a curved slide fastener chain, by planting fastener elements on a pair of fastener tapes 3'—3' by means of a duplex planting machine 18' (refer to FIG. 10(A));

(b) forming a pair of fastener stringers 2'—2', each of which will form the other of a pair of fastener stringers 1' and 2', by planting fastener elements on a pair of fastener tapes 4'—4' by means of the planting machine 18' which is conditioned to give an element pitch different from that in the curved inter-engagement portion of the fastener stringer 1' to the curved inter-engagement portion of the fastener stringer 2' (refer to FIG. 10(D));

(c) inter-engaging each pair of fastener stringers 1'—1' 20 and 2'—2' (refer to FIGS. 10(B) and 10(E));

(d) washing, dewatering and drying the inter-engaged fastener stringers 1'—1' and 2' and 2';

(e) dis-inter-engaging each of the pairs of inter-engaged fastener stringers 1'—1' and 2'—2' (refer to FIGS. 10(C) and 10(F));

(f) inter-engaging one of a pair of the fastener stringers 1'—1' and one of a pair of fastener stringers 2'—2' together to form a curved slide fastener chain; and (g) forming curved slide fasteners by cutting the fastener chain into a predetermined length after applying the necessary parts thereto.

However, it is very time-consuming to produce curved slide fasteners according to the method described above, because each one of a pair of fastener stringers 1' and 2' constituting a curved slide fastener chain are processed and controlled individually or separately in most of the steps explained above. Further, notwithstanding that it is desirable to wash, dewater and dry the fastener chain consisting of a pair of fastener stringers 1' and 2' inter-engaged together in order to obtain a curved slide fastener which can be smoothly opened and closed, in the method described above, the fastener stringers 1' and 2' are inter-engaged together to form a curved slide fastener chain after the washing, dewatering and drying step. Therefore, curved slide fasteners produced by the conventional method above tend to show insufficient opening and closing properties.

Furthermore, since curved slide fastener chains are usually stored in a cylindrical vessel or reeled around a reel so as to facilitate transportation thereof, the curved inter-engagement portion thereof tends to be extended by tensile force continuously applied to the fastener chains.

SUMMARY OF THE INVENTION

It is, accordingly, an object of the present invention to overcome the disadvantages in the prior art curved slide fastener chain by providing a curved slide fastener chain having curved inter-engagement portions which do not deform even when subjected to the tension applied thereto during the production process and transportation of the curved slide fastener chain.

It is another object of the invention to provide a method for producing a curved slide fastener, wherein both of a pair of fastener stringers constituting a curved slide fastener chain are simultaneously, or not separately, formed and thereafter are dealt with as an integral slide fastener chain in the succeeding steps required to form a curved slide fastener.

According to the invention, a curved slide fastener chain comprises a pair of fastener tapes each having a plurality of element rows disposed on the inner side edge thereof in series and spaced relation, wherein each of the element rows includes a straight inter-engagement portion which is substantially inter-engaged with the straight inter-engagement portion opposed thereto and a curved inter-engagement portion most of which is dis-inter-engaged from the curved inter-engagement portion opposed thereto. The element pitches in the straight inter-engagement portions are identical to one another, while the pitch in the curved interengagement portion of one of a pair of fastener tapes is not identical to the pitch in the curved inter-engagement portion of the other of the pair of fastener tapes. Furthermore, the distance between the first effective element of the preceding element row and the first effective element of the element row succeeding thereto in each of a pair of fastener tapes is kept constant.

Further, according to the present invention, a method for producing a curved slide fastener comprises a step of forming a pair of fastener stringers by planting a plurality of element rows on each of a pair of fastener tapes in series and spaced relation, a step of partially inter-engaging a pair of fastener stringers to form a fastener chain, a step of washing, dewatering and drying the fastener chain while applying tension thereto, and a step of forming slide fasteners by cutting the slide fastener chain into a unit length after applying parts, such as sliders, to the fastener chain. In the step of forming fastener stringers, the planting of the elements is so performed that the distance between the first elements in the respective element rows disposed adjacent to one another is substantially constant. In the step of inter-engaging a pair of fastener stringers, a pair of fastener stringers are inter-engaged to form a fastener chain in which at least most of the curved inter-engagement portions is dis-inter-engaged and is thereafter supplied to the succeeding step of washing, dewatering and drying the fastener chain where the fastener chain is processed with at least most of the curved inter-engagement portion thereof being dis-inter-engaged.

DETAILED DESCRIPTION OF THE INVENTION

Figure 1:
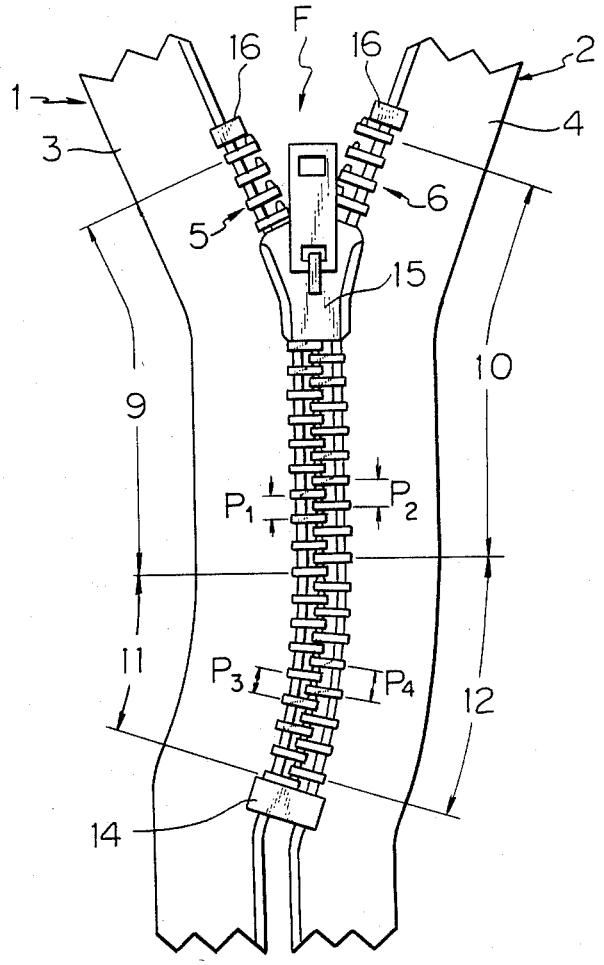
FIG. 1 is a front view of a curved slide fastener.
Figure 2:
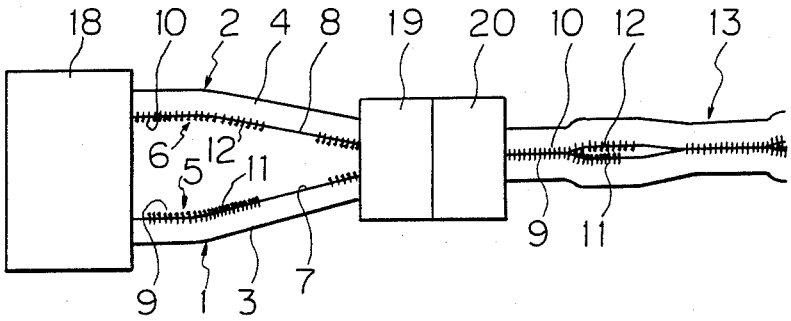
FIGS. 2 to 5 are plan views illustrating sequential steps of a method for producing curved slide fasteners according to the invention.
Figure 3:
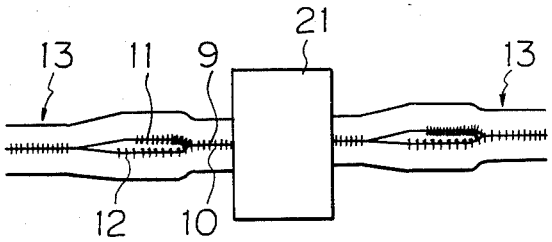
Figure 4:
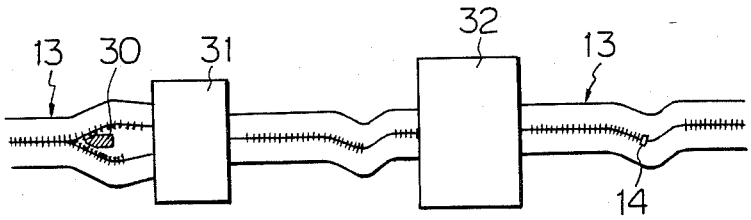
Figure 5:
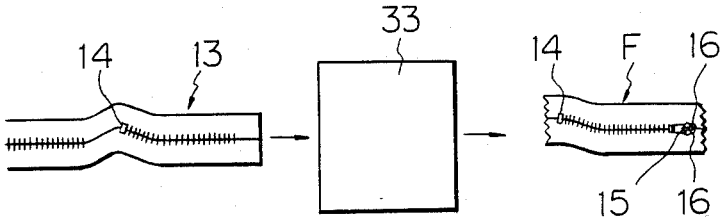

Referring to FIGS. 2 to 5, a method for producing a curved slide fastener of the invention is illustrated. FIG. 2 shows a step of forming a pair of fastener stringers, 1 and 2 and a step of inter-engaging the fastener stringers to form a fastener chain; FIG. 3 shows the steps of washing, dewatering and drying the fastener chain while applying tension thereto; and FIG. 4 and FIG. 5 show a step of forming a curved slide fastener by cutting the fastener chain into a unit length after applying thereto bottom stops 14, sliders 15 and upper stops 16.

In the step of forming fastener stringers, a pair of fastener stringers 1 and 2 are simultaneously formed by planting fastener elements constituting straight and curved inter-engagement portions on a pair of fastener tapes 3 and 4. The planting of the elements on a pair of fastener tapes is so performed that element rows 5 and 6 are disposed on the respective inner edge of a pair of the fastener tapes in series and spaced relation.

Figure 6:
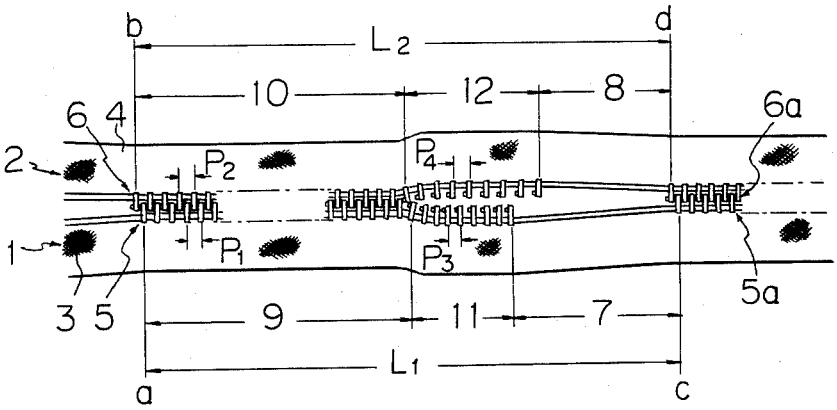
FIG. 6 is a plan view illustrating a part of a curved slide fastener chain of the invention.

As shown in FIGS. 2 and 6, each of the element rows 5 and 6 have a straight inter-engagement portion 9 or 10 and a curved inter-engagement portion 11 or 12 next to the straight portion. The element pitches P1 and P2 in the straight portions 9 and 10, respectively, are identical to one another, while the elment pitches P3 and P4 are not identical to each other. In the embodiment illustrated in FIG. 6, the curved portions 11 and 12 are so formed that the element pitch P4 is larger than the element pitch P3. However, relation between the pitch P3 and pitch P4 relative to one another may optionally be selected depending upon the expected configuration of a curved portion.

In this connection, the relation between the pitches P3 and P4 can typically be represented by the following three formulas:

(1) $P1=P2=P3<P4$ (this corresponds to the embodiment shown in FIG. 6)

(2) $P1=P2=P4>P3$ (3) $P3<P1=P2<P4$

As shown in FIG. 6, the element rows 5 and 6 are formed on the respective fastener tapes 3 and 4, so that the distance L1 [measured from the first element (a) of the element row 5 to the first element (c) of an element row 5*a* next to the row 5] and the distance L2 [measured from the first element (b) of the element row 6 to the first element (d) of an element row 6*a* next to the row 6] are identical to one another.

It is noted that, in contrast with the aforementioned conventional curved slide fastener chain, according to the invention, the spaces 7 and 8 formed between the element rows 5 and 5*a* and the element rows 6 and 6*a*, respectively, are not of the same length, since the distances L1 and L2 mentioned above are identical to one another.

Figure 7:
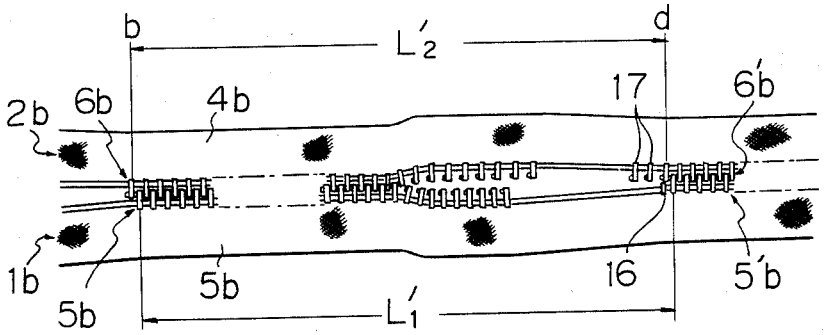
FIG. 7 is a plan view illustrating another embodiment of the curved slide fastener chain according to the invention.

Referring to FIG. 7 illustrating another embodiment of the invention, fastener stringers 1*b* and 2*b*, which form a curved slide fastener having only one upper stop 16 applied to the fastener stringer 1*b*, are shown. As shown, fastener element row 6*b*′ which is next to the element row 6*b* has non-inter-engagement elements 17 disposed at the position opposite to the upper stop 16, while the fastener stringers 1 and 2 illustrated in FIG. 6 are both formed with their respective upper stops (not shown). In this embodiment, it is noted that the distances L1′ and L2′ correspond to the measurement of the respective gaps between their effective elements to be inter-engaged.

In the step of inter-engaging the fastener stringers, a pair of fastener stringers 1 and 2 formed in the preceding step are inter-engaged together over the entire length of each of the element rows 5 and 6 by means of an inter-engaging device 19 and thereafter the curved inter-engagement portions 11 and 12 are dis-inter-engaged by means of a dis-inter-engaging device 20. Thus, a fastener chain 13 having straight inter-engagement portions which are inter-engaged and curved inter-engagement portions which are dis-inter-engaged is formed. However, instead of employing the combined step of inter-engaging and dis-inter-engaging a fastener chain, the fastener chain 13 having dis-inter-engaged curved inter-engagement portions can be formed by inter-engaging only the straight inter-engagement portions 9 and 10. Further, though the curved inter-engagement portions are shown to be inter-engaged over their entire length in the embodiment shown in FIG. 2, the curved inter-engagement. portions may be partly inter-engaged, provided that the greater part thereof is dis-inter-engaged. Furthermore, it is also permissible for the dis-inter-engagement portion to extend slightly into the straight portions.

Figure 8:
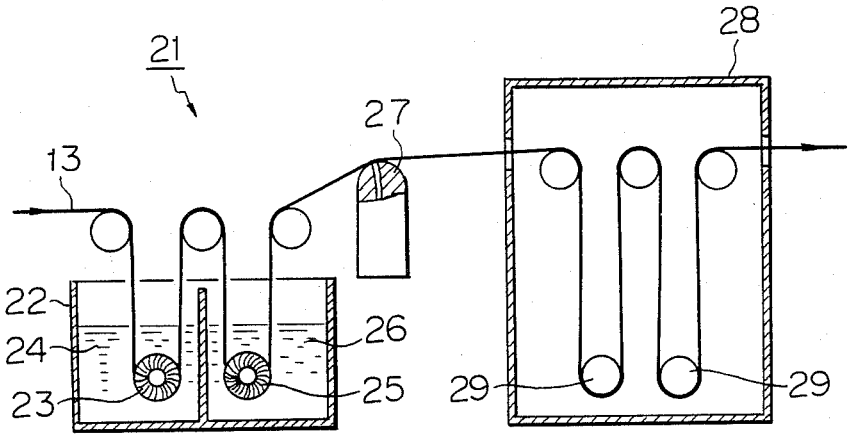
FIG. 8 is a cross-sectional view illustrating an installation for washing, dewatering and drying a curved slide fastener chain of the invention.
Figure 9:
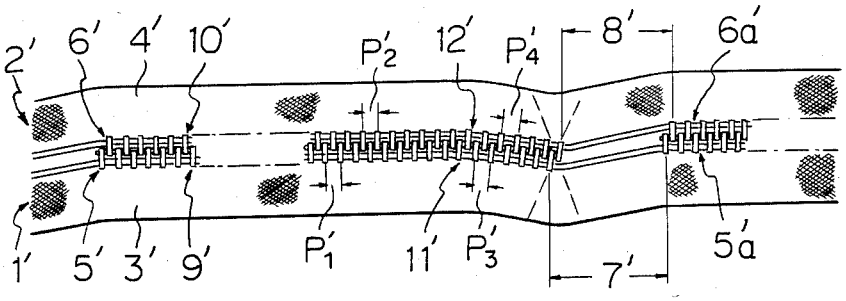
FIG. 9 is a plan view illustrating a curved slide fastener chain according to prior art.
Figure 10:
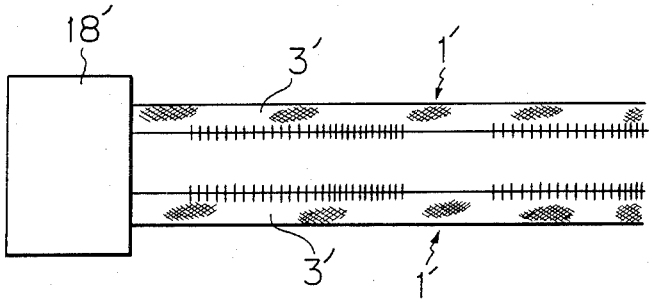
FIGS. 10(A) to 10(F) are plan views showing the respective steps in a method for producing a curved slide fasteners according to prior art.
Figure 10:
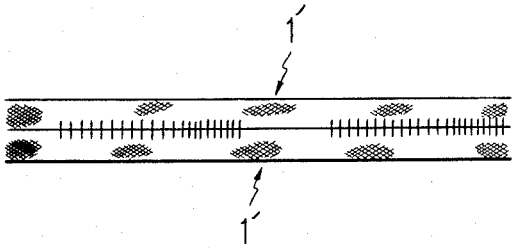
Figure 10:
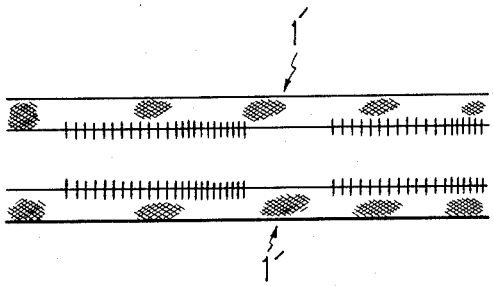
Figure 10:
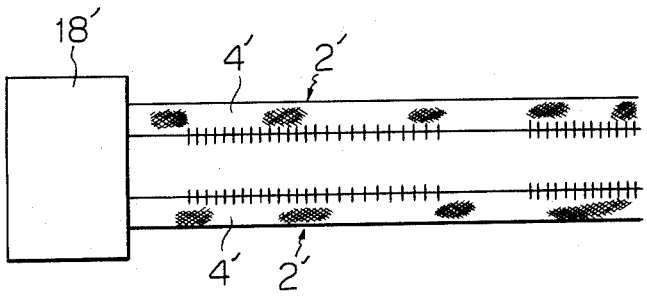
Figure 10:
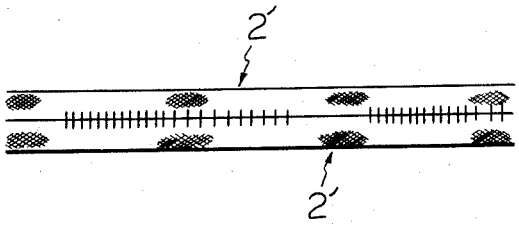
Figure 10F:
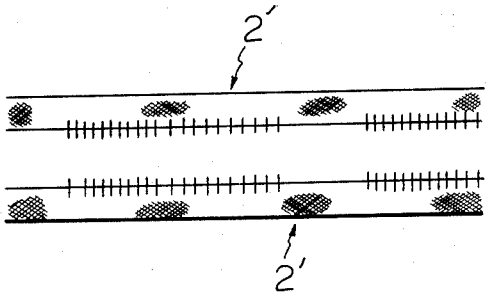

In the step of washing, dewatering and drying the fastener chain which follows the forming step described above, the fastener chain having dis-inter-engaged curved portions is supplied to a washing, dewatering and drying unit 21 shown in FIG. 8. In the unit 21, the fastener chain 13 is washed in a water vessel containing washing liquid 24 by means of a first roll brush 23 and thereafter is cleaned in a reservoir 22 containing water 26 by means of a second roll brush 25. Further, the fastener chain 13 is dewatered by passing through a dewatering device 27 of vacuum type. Then the fastener chain 13 is dried and ironed on a plurality of tension rollers 29 in thermal drying equipment 28.

The washing, dewatering and drying step described above is an important step which is conventionally applied to the fastener chain in order to remove impurities, such as powdered shavings from the element material, machine oil and smudge, adhered to the fastener chain and also to stabilize quality of the fastener chain.

In the subsequent step of forming a curved slide fastener, as shown in FIG. 4, bottom stops 14 are attached to the fastener chain by means of a bottom stop applying device 32. Since it is requried that all the inter-engagement portions including straight and curved portions of the fastener chain brought from the preceding step are completely inter-engaged in order to achieve the attachment of the bottom stops 14, all the inter-engagement portions are inter-engaged by means of an inter-engaging device 31 after all the inter-engagement portions have been once dis-inter-engaged over their entire length by a dis-inter-engaging device 30 and thereafter the bottom stops 14 are attached to the fastener chain 13. Subsequently, as shown in FIG. 5, sliders 15 are attached to the inter-engaged fastener chain 13 through the spaces 7 and 8 and thereafter upper stops 16 are applied to the fastener chain by means of a finishing device 33. Finally, the fastener chain 13 is cut at the intermediate portion of each of the spaces 7 and 8 to form the desired curved slide fasteners.

As described above, according to the invention, a curved slide fastener chain having curved inter-engagement portions each of which is dis-inter-engaged is provided. Because of the dis-inter-engaged configuration of the curved inter-engagement portions, both of a pair of fastener stringers are able to extend in a straight line, so that there is no need to process a pair of fastener stringers individually or separately in the step of washing, dewatering and drying the fastener chain where curved portions tend to deform easily because of heat and tension.

Thus, it is possible to deal with a pair of fastener stringers which are combined together throughout the whole process for producing a curved slide fastener. This contributes to easy process control and an advanced productivity in producing curved slide fasteners in comparison to the prior-art method.

I claim:

1. A method for producing a curved slide fastener including a pair of element rows each having straight and curved inter-engagement portions comprising the steps of:

forming fastener stringers by planting a plurality of element rows of a predetermined length on each of the fastener tapes of the fastener stringers in series and spaced relation;

inter-engaging a pair of fastener stringers to form a fastener chain;

washing and dewatering said fastener chain and drying the same while applying tension thereto;

finishing said fastener chain to form slide fasteners by cutting said slide fastener chain into a unit length after applying parts, such as sliders, to said fastener chain;.

characterized in that:

(a) in the step of forming fastener stringers, a pair of fastener stringers are so formed simultaneously that the fastener elements constituting straight and curved inter-engagement portions are planted on each of the inner side edges of said fastener tapes with the element pitch in the curved inter-engagement portion of one of the pair of fastener stringers being larger than the element pitch in the curved inter-engagement portion of the other of the pair of fastener stringers;

(b) in the step of inter-engaging the pair of fastener stringers, the pair of fastener stringers are inter-engaged to form a fastener chain in which at least most of said curved inter-engagement portions are dis-inter-engaged; and (c) in the step of washing, dewatering and drying the fastener chain, said fastener chain is processed with the curved inter-engagement portions being at least party not inter-engaged.

* * * * *